US005628067A

United States Patent [19]

Meyer et al.

[11] Patent Number: 5,628,067

[45] Date of Patent: May 13, 1997

[54] LIQUID IMPERVIOUS SLEEVE-GLOVE INTERFACE FOR PROTECTIVE GARMENTS AND METHOD OF PRODUCING SAME

[75] Inventors: Kenneth K. Meyer, Sayre, Pa.; William C. Beck, deceased, late of Catawissa, Pa., by Mary B. Kremser, executor

[73] Assignee: Donald Guthrie Foundation for Education and Research, Sayre, Pa.

[21] Appl. No.: 497,949

[22] Filed: Jul. 3, 1995

[51] Int. Cl.[6] ..... A41D 13/10; A41D 13/12

[52] U.S. Cl. ..... 2/125; 2/161.7; 2/162; 2/270; 2/51; 2/901

[58] Field of Search ..... 2/51, 114, 125, 2/161.7, 161.6, 159, 270, 162, 69, 160, 161.1, 115, 123, 901, 169, 275, 59, 168

[56] References Cited

U.S. PATENT DOCUMENTS

| | | | |
|---|---|---|---|
| 2,655,663 | 10/1953 | Hoagland | 2/270 |
| 2,813,272 | 11/1957 | Hagan | 2/270 |
| 3,747,126 | 7/1973 | Hoagland | 2/270 |
| 4,114,200 | 9/1978 | Smith et al. | 2/51 |
| 4,752,972 | 6/1988 | Neckerman et al. | 2/123 |
| 4,868,927 | 9/1989 | Bourdeau et al. | 2/162 |
| 4,947,868 | 8/1990 | Schoolman | 128/847 |
| 4,991,232 | 2/1991 | Taylor | 2/115 |
| 4,996,722 | 3/1991 | Jimenez et al. | 2/114 |
| 5,001,785 | 3/1991 | Heiman et al. | 2/123 |
| 5,033,115 | 7/1991 | Bowling et al. | 2/51 |
| 5,073,988 | 12/1991 | Lewis, Jr. et al. | 2/123 |
| 5,097,534 | 3/1992 | Viemeister et al. | 2/69 |

*Primary Examiner*—Amy B. Vanatta
*Attorney, Agent, or Firm*—Foley & Lardner

[57] ABSTRACT

A liquid proof protective garment and protective glove assembly wherein the interface of the garment and gloves is sealed together in a manner to produce a liquid impervious seal between the garment and the glove. The liquid impervious garment-glove interface assembly of the present invention is particularly adapted for use with surgical gowns. The liquid impervious seal is produced by narrowing the diameter of the distal end of the protective garment over which the protective glove is placed. The junction of the garment and glove is then sealed with a flexible liquid adhesive, which upon drying, produces a protective garment-glove assembly which is impervious to liquids and protects the wearer from potentially harmful intrusions of liquid into the interior of the assembly at the garment-glove juncture.

14 Claims, 2 Drawing Sheets

LIQUID IMPERVIOUS SLEEVE-GLOVE INTERFACE FOR PROTECTIVE GARMENTS AND METHOD OF PRODUCING SAME

FIELD OF INVENTION

This invention relates to a sleeve and glove assembly for a surgical gown, protective garment or the like, and more particularly to the creation of a liquid impervious interface between the sleeve and glove.

BACKGROUND OF THE INVENTION

The concept that the wearing of a surgical gown and surgical gloves will protect a healthcare provider's torso and upper extremities from contamination by blood and body fluids is generally accepted. However, one of the problems encountered by healthcare providers in a surgical setting is that this protective barrier may become breached during interaction of the health care professional with the patient. With the rapid increase of cases of highly infectious diseases, such as AIDS and hepatitis, the medical field has become increasing concerned not only with protecting the patients, but with protecting the healthcare provider from patients' infectious diseases. This is especially true in emergency situations either in the emergency room of a hospital or at the site of an accident where it unknown if a patient is carrying the HIV virus or some other infectious disease. In such a situation a gown or garment is required which can adequately protect the health care provider.

That harm to a healthcare provider may result from breach of the protective gown or glove has been known for many years. To avoid such a breach, there has been a host of materials employed for both gowns and gloves to improve the quality and to support their validity. Indeed, public standards for the quality of these barriers have been proposed by the American Society of Testing Materials (ASTM). For surgical gowns these Standards are so strict that they preclude the transfer of liquids and even viral particles, which could pass through a pinhole under pressure of 2 PSI. For surgical gloves, ASTM Standard D 5151 permits an Acceptable Quality level for holes of 2½% with a hole defined as a "defect permitting the passage of water with the glove pressured by 1000 ml of water."

However, despite the large amount of attention paid to the development of materials used in these barriers, little, if any, attention has been paid to their design, particularly, the junction or interface between the sleeve of the gown and the glove. It is at this interface that body fluids, which may contain harmful or infectious diseases, breech the protective barrier worn by the healthcare provider.

Hospital-type gowns proposed heretofore usually are provided with sleeves each terminating in a cuff at the outer end which is usually in the form of a stretchable cuff made of stockinette material. Ordinarily, the stretchable stockinette cuff of gowns do not have optimum hydrophobic properties. At the gown-glove interface, not only can an aqueous liquid flow freely between the glove and gown, but distribution of such penetrating body fluids is encouraged by the absorbent stockinette cuff. Although glove manufacturers have provided glove cuffs which do not easily roll down to expose this area of the gown, the interface between the gown and the glove remains extremely vulnerable to fluids.

Thus, present hospital-type gowns when worn with gloves provide for a gown-glove interface that fails to fully protect the wearer from potentially hazardous blood and other bodily fluids. It would therefore be advantageous to be able to create a liquid impervious barrier at the gown-glove interface to enable healthcare providers to be adequately protected from potentially harmful bodily fluids from patients. Additionally, it would be beneficial if such a liquid impervious barrier at the gown-glove interface could be created by utilizing the standard gowns and gloves currently used by health care workers. The present invention provides for these benefits.

SUMMARY OF THE INVENTION

The liquid impervious gown-glove assembly of the present invention finds particular utility in its application to the sleeve of a surgical gown which protects the sterile field in an operating room, or protects the healthcare worker in a variety of settings. The gown-glove assembly may be applied to conventional, reusable surgical gowns if a removable adhesive is used, or disposable gowns if the adhesive used is permanent, and any commonly available, liquid resistant gloves, well known in the art.

The present invention alleviates a substantial portion of the risk associated with conducting surgery on, or otherwise treating, patients who are afflicted with AIDS and other extremely communicable and hazardous diseases.

However, the liquid impervious gown-glove assembly of the present invention has many uses other than for surgical gowns or as general protection to healthcare providers. For example, the invention may be applied to protective industrial clothing or in garments which protect against the elements in various types of sportswear such as ski jackets and suits.

When used by a health care provider, the invention is intended for use whether or not the health care provider knows the patient is infected, thereby reducing the risk especially associated with patients who have recently acquired a disease but who do not test positive or were not tested at all. The invention is also designed to not unduly encumber the health care provider or hamper dexterity thereby making use of the invention attractive to health care providers, especially to surgeons, for all surgeries performed.

An additional benefit of the invention is its ability to be utilized with standard gowns and gloves presently being used in hospital settings. There is no requirement in the present invention for specially created gloves or gowns. Further, the seal at the gown and glove interface may be created just prior to use, to ensure integrity of the seal.

In one aspect of the invention, a liquid proof protective gown with tapered distal sleeve is utilized to allow a portion of the distal sleeve to fit inside the cuff of a liquid proof protective glove which is donned over at least a portion of the sleeve. The juncture of the proximate, or open end, of the glove with the sleeve is then sealed with a flexible liquid resistant adhesive to create a liquid impervious gown-glove interface.

In another preferred embodiment of the present invention, the distal sleeve portion of a standard, broad sleeved, liquid resistant hospital gown is shirred to produce a darted sleeve. The distal sleeve terminus of the gown is adapted to the circumference of the wearer's forearm by creating a smooth dart, either by incising a portion of the terminal sleeve end along its length and folding the created flaps of material over each other, or simply by folding the flaps of gown material over each other without any incision. The terminal sleeve gown flaps are then sealed to each other with a liquid resistant adhesive medium. Subsequently, a suitable liquid impervious glove is donned with the glove covering at least a portion of the distal end of the gown sleeve. The proximate extremity of the glove is then sealed to the subadjacent sleeve portion with a flexible, liquid resistant adhesive.

In a further embodiment of the present invention, a liquid impervious glove is donned over at least a portion of a sleeve of a liquid impervious gown. The interface between the sleeve and glove is then covered with an oversleeve of latex, or other suitable liquid impervious material. The latex over-sleeve is subsequently sealed with a liquid resistant adhesive to the subadjacent gown at the proximal end and sealed with the liquid resistant adhesive to the glove at the distal end of the over-sleeve.

Other features, objects, uses and advantages of this invention are apparent from the following description taken in conjunction with the accompanying illustrations.

DETAILED DESCRIPTION OF THE INVENTION

The term "interface" is defined herein to mean the juncture between the proximate or open end of a glove and the subadjacent portion of a protective garment immediately underlying the proximate end of the glove.

The sleeve of the modern liquid resistant gown utilized by health care providers is a wide, loose and baggy sleeve design. The distal end of such sleeve may measure about 30 cm and more in circumference. The stockinette, found attached to the terminal portion of the sleeve of most surgical gowns, is required to gather the extra material of the gown and form a snug fitting wrist portion.

Figure 1:
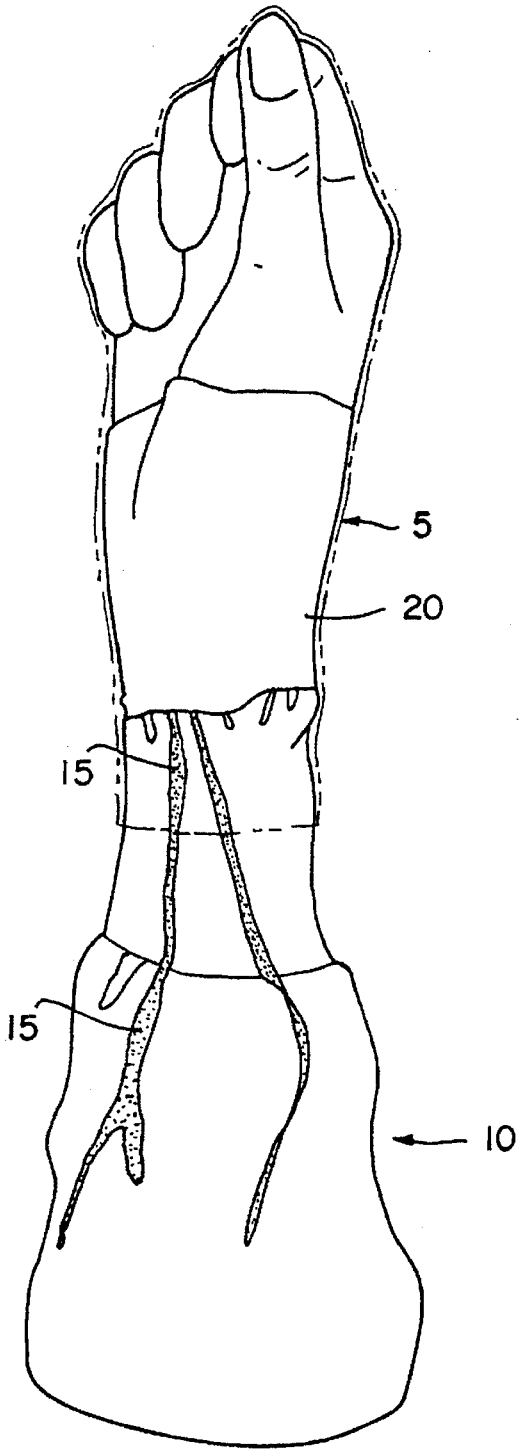
FIG. 1 (PRIOR ART)
FIG. 1 is an illustrative view of a glove and gown on the hand and forearm of a surgeon which illustrates the grooves and channels created on a wide sleeve of a standard hospital gown with a stockinette cuff.

The standard latex glove, which is used in medical procedures, has a circumference of 15–17 cm. The properly worn surgical glove completely covers the stockinette commonly found at the distal portion of hospital glove sleeves. The glove, when worn, is positioned 3 cm or more proximal to the sleeve/stockinette junction. Therefore, the sleeve must enter the glove in folds and pleats. These folds and pleats extend from the portion of the sleeve covered by the glove to the portion of the sleeve extending from the glove, forming a series of troughs for blood and body liquids to reach the interior of the glove, stockinette, and ultimately the skin of the gown-glove wearer. This is illustrated in FIG. 1. As shown in FIG. 1., when a standard surgical latex glove 5 is placed over the distal portion of a gown sleeve channels 15, originating at the stockinette 20, appear in the gown sleeve 10. These channels 15 extend from the stockinette 20 to the portion of the gown sleeve 10 which is not covered by the glove 5. These channels 15 act as runways by which blood and other body fluids may channel into the interior of the glove 5 to the stockinette 20. Moreover, because of the porosity of the material used to create the stockinette 20, the stockinette 20 may act as a wick, drawing up fluids and spreading the potentially contaminated fluid to the recently scrubbed forearm skin.

The gown used in accordance with the present invention is preferably one which does not have a stockinette at the terminal portion of the gown sleeve, but merely terminates with a cloth portion. A standard gown with a stockinette may be utilized, with the stockinette being removed prior to the gown's use.

The current invention relies on a tapered sleeve, wherein the sleeve of the gown is sealed to itself with a liquid resistant seal, thus eliminating the need for a stockinette. To allow the glove cuff to fit over the distal end of the gown sleeve, it is necessary to narrow this portion of the sleeve of a standard gown in some fashion. Preferred constructions include: shirring the distal sleeve portion, wherein the sleeve terminus is retained in a shirred position by sewing the shirred portions together; incising the distal sleeve portion of the gown along its length and folding the created flaps over each other; or by simply folding the material of the distal sleeve portion over each other as shown in FIG. 2.

Figure 2:
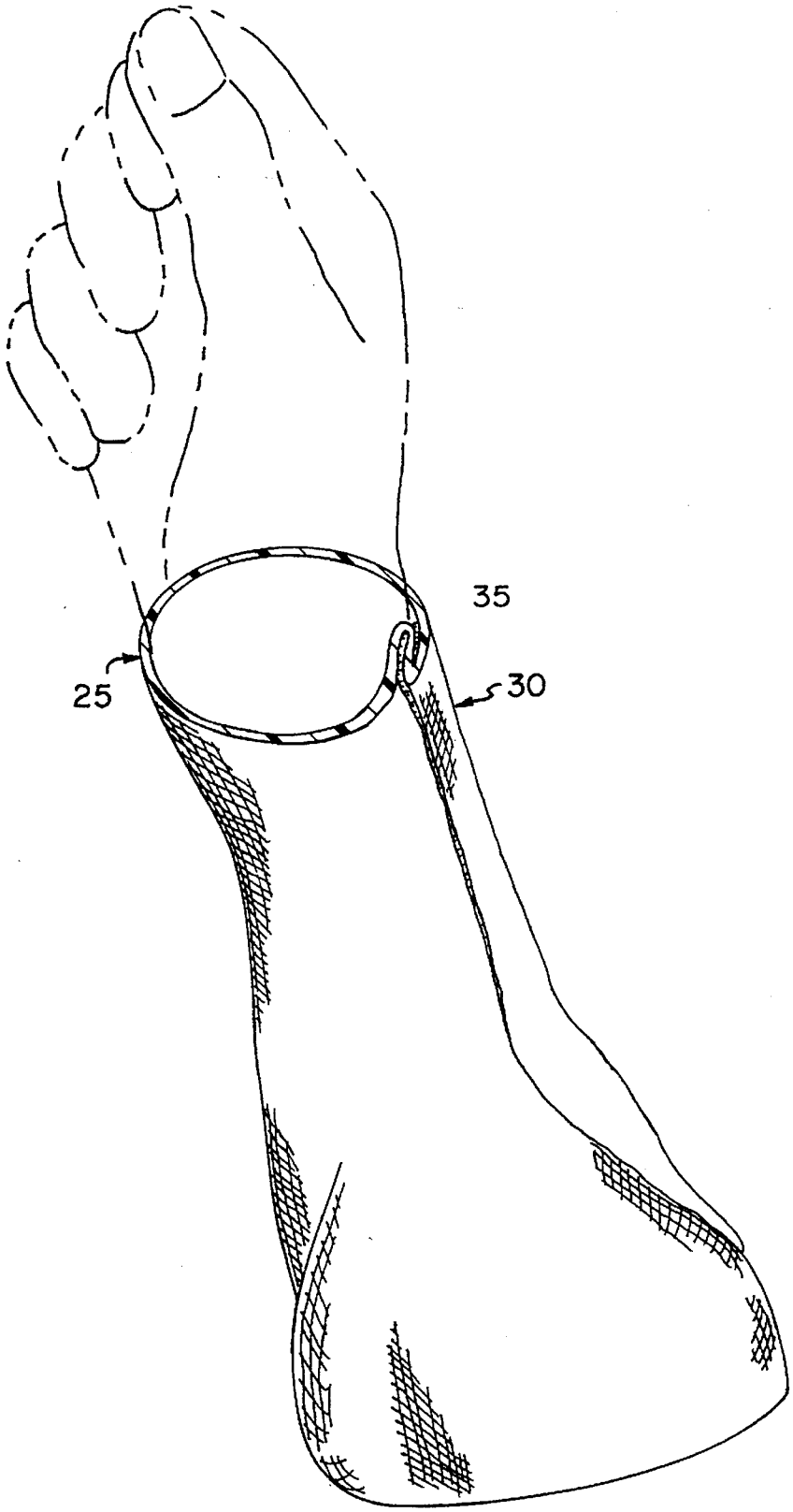
FIG. 2 is a partially cut away view showing a hospital gown sleeve without a stockinette cuff that has been sealed to itself in accordance with the invention.

As FIG. 2 illustrates, a terminal sleeve portion 25 of a gown 30 terminates as a broad cuff without gathering the excess cuff material with a stockinette. The terminal sleeve portion 25 is narrowed by folding the distal material over itself and then sealing the folded over material to itself with a liquid resistant seal 35.

Alternatively, a liquid resistant gown may be produced which has a sleeve which is tapered at its terminal portion. The wrist opening of this tapered sleeve may be wide enough to allow the wearer's wrist and hand to fit through, yet maintain a narrow diameter to allow a standard liquid resistant glove to fit over at least a portion of the gown sleeve without producing unnecessary grooves and channels in the gown material. This embodiment does not require the gown be sealed to itself with an liquid resistant seal.

Additionally, a liquid resistant gown having a tapered sleeve wherein the tapered portion contains a slit at the terminal end to enable the wearer to the gown fit his or her wrist and hand through the wrist opening may be used. This gown design requires that the gown material from one side of the slit be folded over the material on the other side of the slit and sealed in place with a liquid resistant seal.

Figure 3:
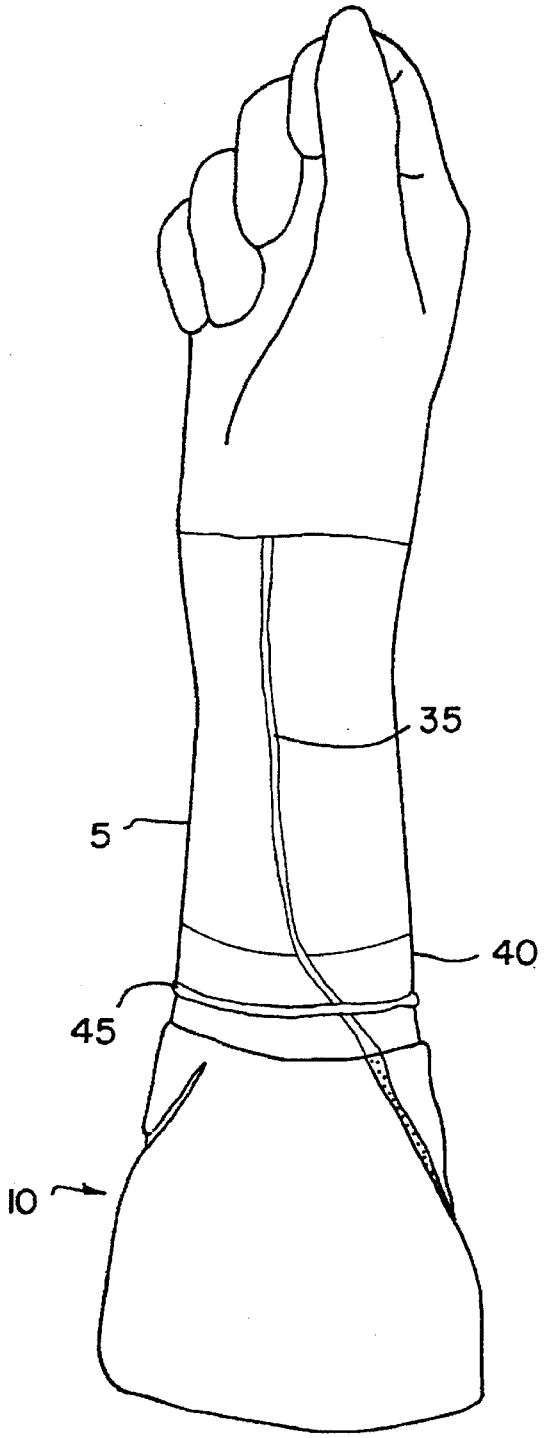
FIG. 3 is a sectional view of the distal end of a gown sleeve illustrating the placement of liquid impervious seal in accordance with the present invention within the gown-glove interface.

One embodiment of this invention is illustrated in FIG. 3. After the channels in the gown sleeve 10 have been eliminated by folding excess gown material over itself and sealing the gown material to itself with a liquid resistant seal 35, the liquid resistant glove 5 is donned by the gown wearer such that the glove cuff 40 covers at least a portion of the sleeve terminus. The junction where the proximal portion of the glove cuff, i.e. the glove opening, meets the gown sleeve is the gown-glove interface. This gown-glove interface is then sealed with a liquid resistant seal 45.

Alternatively, after the glove is donned, a latex oversleeve may be placed over the gown-glove interface and the distal end of the latex oversleeve is then sealed to the glove, and the proximate end of the latex oversleeve is sealed to the sleeve. The term "oversleeve" is herein defined as a band of tubularly shaped liquid resistant material of sufficient length so as to completely cover the gown-glove interface when drawn over the gown-glove interface.

The liquid resistant seal prevents the passage of liquids such as blood and other bodily fluids from seeping between the glove and gown, thereby maintaining the integrity of the barrier between the gown/glove and the wearer. The seal may comprise any liquid resistant adhesive. Examples of such material include latex rubber, emulsions of solvent solutions or rubber based adhesives, natural or synthetic. Certain acrylic base pressure sensitive adhesives may also be used, provided they are capable of providing a liquid resistant seal. The material used for the seal should be flexible and non-bulky and of sufficient strength to maintain its liquid impervious characteristics during use. It is important that any adhesive used be resilient and have a large degree of flexibility in order to allow the wearer to maintain flexibility of motion without jeopardizing the seal. In addition to an adhesive other methods and materials may be used to seal the gown-glove interface and the gown material to itself. Such seals may comprise a heat-sealed gown-gown or gown-glove seal or other appropriate means.

Alternatively, a cohesive-adhesive substance may be used as the seal in various stages of the invention. A cohesive-adhesive material is defined herein as a material which has an affinity only for itself and consequently has little or no tack for surfaces other than those similar to itself. The liquid resistant gown, for example, may have its terminal sleeve portions impregnated with such materials to enable a liquid resistant seal to be easily formed when the gown material is folded over itself. Examples of such material include those cited previously, provided the adhesive of choice is capable of adhering to have an affinity for bonding only to itself.

The following non-limiting examples further illustrate the present invention.

EXAMPLE 1

Unsealed Gown-Glove Interface

To determine if it was possible to achieve a impermeable barrier between the wearer and the gown-glove interface without employing any seal, an inner liquid resistant glove was donned by the user and a standard liquid resistant gown donned over the inner glove in order to provide internal protection against blood and other bodily fluids. An outer liquid resistant glove was then placed over the terminal portion of the gown sleeve and the inner glove. The user then inserted this covered hand into water until the water reached a level of 5 cm above the outer glove cuff. Water penetrated immediately, soaking the stockinette and the space between the gloves but the hand and wrist remained dry. When the forearm was raised above a horizontal plane, water from between the stockinette and gloves ran up the forearm under the inner surface of the glove.

EXAMPLE 2

Seal Applied to Gown Only

The ability of a gown-glove system to maintain its integrity against liquids wherein only the gown portion was tapered and sealed to itself with a liquid resistant adhesive without further sealing of the gown-glove interface was tested as follows.

The stockinette was removed from the terminal sleeve portion of a standard liquid resistant surgical gown and the material at the terminal portion of the sleeve cut and gored. The wearer donned the gown, and the gore was sealed with a liquid resistant adhesive, thereby producing a gown whose terminal sleeve portion was tapered and impervious to liquids. Standard liquid resistant surgical gloves were then placed over the terminal-portion of the sleeve and the wearer placed the hand protected by the gown and glove into water until the water reached a level approximately 5 cm above the glove cuff. No water came through into the interior of the gown as long as the hand and arm remained in a stationary position. However, rotary movement of the wrist or arm caused small wrinkles and grooves to appear in the gown material through which water rapidly ran into the gown, under the glove, and onto the skin of the hand and wrist.

EXAMPLE 3

Double Glove with Sealed Gown and Unsealed Interface

The test as in Example 2 was repeated, with the addition of an inner liquid resistant glove being donned by the wearer prior to the user donning the gown. The results were similar when the user placed the gloved hand into water 5 cm above the glove cuff, allowing water to wet the skin of the hand and wrist.

EXAMPLE 4

Sealed Gown-Glove Interface

The test was repeated as in Example 2, with the addition of a liquid resistant adhesive being applied to the gown-glove interface. The user inserted the glove covered hand into water until the water reached a level of 5 cm above the sealed interface. Rotary motion was applied to the wrist and arm without any observable wetting of the interior of the gown or the wearer's skin.

While the various features of this invention are illustrated and described as being particularly adapted to provide a hospital-type gown-glove liquid impervious interface for use by health professionals, it is to be understood that various features of this invention can be utilized singly or in various combinations thereof to provide adequate and impervious interfaces for gown and gloves for other uses as desired. The illustrated embodiment is defined in terms of standard, disposable hospital gowns modified particularly for use with the present invention. Other protective garment designs will permit use with the present invention without post production modification. Therefore, this invention is not to be limited to only the embodiment illustrated in the drawings, because the drawings are utilized to illustrate one of the wide variety of uses of this invention.

We claim:

1. A liquid impervious sleeve and glove assembly for a protective fabric garment, comprising: a protective garment having a sleeve with a terminal sleeve forearm portion, the terminal sleeve portion having folds of material, a glove wherein the glove covers at least part of the terminal sleeve forearm portion, a liquid impervious seal which seals the folds in the terminal sleeve portion to the terminal sleeve portion and a liquid impervious seal which seals the glove to the sleeve at the interface wherein each liquid impervious seal is selected from the group consisting of an adhesive, a cohesive-adhesive, and a heat seal.

2. The liquid impervious sleeve and glove assembly for a protective garment according to claim 1 wherein the protective garment is a surgical gown.

3. The liquid impervious sleeve and glove assembly for a protective garment according to claim 1 wherein the liquid impervious seal is an adhesive having a high modulus of elasticity.

4. The liquid impervious sleeve and glove assembly for a protective garment according to claim 2 wherein the surgical gown is made of a liquid strike-through resistant cloth.

5. The liquid impervious sleeve and glove assembly for a protective garment according to claim 1 wherein the terminal sleeve forearm portion is folded over itself and sealed to itself by the sealing means.

6. A liquid impervious sleeve and glove assembly for a protective garment, comprising:

a liquid resistant protective garment having a darted forearm sleeve portion, the darted sleeve portion being folded over itself and having a sealing means for creating a liquid proof seal along the folded sleeve portion, a liquid resistant glove wherein the glove covers at least a portion of the sealed folded forearm sleeve portion, and a liquid proof seal at the interface of the glove and the sleeve.

7. The liquid impervious sleeve and glove assembly for a protective garment according to claim 6 wherein the protective garment is a surgical gown.

8. The liquid impervious sleeve and glove assembly for a protective garment according to claim 6 wherein the liquid proof seal is an adhesive.

9. The liquid impervious sleeve and glove assembly for a protective garment according to claim 8 wherein the adhesive has a high modulus of elasticity.

10. The liquid impervious sleeve and glove assembly for a protective garment according to claim 7 wherein the surgical gown is made of a liquid strike-through resistant cloth.

11. A method of producing a liquid impervious sleeve and glove assembly for a protective garment, comprising:

providing a liquid impervious protective garment having a sleeve forearm portion;

folding the sleeve forearm portion over itself;

sealing the folded over sleeve forearm portion to itself with a liquid proof seal;

placing a liquid impervious glove over at least a part of sleeve forearm portion; and sealing the junction of the glove and sleeve with a liquid proof seal between the glove and the sleeve;

wherein each liquid proof seal is selected from the group consisting of an adhesive, a cohesive-adhesive, and a heat seal.

12. The method of producing a liquid impervious sleeve and glove assembly for a protective garment according to claim 11 wherein the liquid proof seal is an adhesive having a high modulus of elasticity.

13. The method of producing a liquid impervious sleeve and glove assembly for a protective garment according to claim 11 wherein the protective garment is a surgical gown.

14. The method of producing a liquid impervious sleeve and glove assembly for a protective garment according to claim 13 wherein the surgical gown is made of a liquid strike-through resistant cloth.

* * * * *

UNITED STATES PATENT AND TRADEMARK OFFICE

CERTIFICATE OF CORRECTION

PATENT NO. : 5,628,067

DATED : May 13, 1997

INVENTOR(S) : Kenneth K. Meyer, William C. Beck, deceased (late of Catawissa, PA, by Mary B. Kremser, executor)

It is certified that error appears in the above-indentified patent and that said Letters Patent is hereby corrected as shown below:

In Column 3, Line 57 , "gown sleeve channels" should be --gown sleeve 10, channels--.

In Column 5, Line 61 , "terminal-portion" should be --terminal portion--

In Column 8, Line 5 ., "sleeve forearm" should be --the sleeve forearm--.

Signed and Sealed this

Tenth Day of February, 1998

Bruce Lehman

*Attest:*

BRUCE LEHMAN

*Attesting Officer*

*Commissioner of Patents and Trademarks*